US007064476B2

(12) United States Patent
Cathey

(10) Patent No.: US 7,064,476 B2
(45) Date of Patent: Jun. 20, 2006

(54) EMITTER

(75) Inventor: David A. Cathey, Boise, ID (US)

(73) Assignee: Micron Technology, Inc., Boise, IA (US)

( * ) Notice: Subject to any disclaimer, the term of this patent is extended or adjusted under 35 U.S.C. 154(b) by 281 days.

(21) Appl. No.: 09/759,746

(22) Filed: Jan. 12, 2001

(65) Prior Publication Data

US 2002/0093281 A1 Jul. 18, 2002

Related U.S. Application Data

(60) Continuation of application No. 08/609,354, filed on Mar. 1, 1996, now Pat. No. 6,825,596, which is a division of application No. 08/089,166, filed on Jul. 7, 1993, now Pat. No. 5,532,177.

(51) Int. Cl.
*H01J 1/14* (2006.01)

(52) U.S. Cl. ..... 313/336; 313/309; 313/351; 313/495; 313/311; 257/101; 257/103; 257/219

(58) Field of Classification Search ..... 313/336, 313/495, 309, 351, 311, 499, 498; 257/101, 257/103, 611, 549, 550, 219
See application file for complete search history.

(56) References Cited

U.S. PATENT DOCUMENTS

| | | | | |
|---|---|---|---|---|
| 3,665,241 | A | 5/1972 | Spindt et al. | 313/351 |
| 3,755,704 | A | 8/1973 | Spindt et al. | 313/309 |
| 3,812,559 | A | 5/1974 | Spindt et al. | 29/25.18 |
| 3,816,194 | A | 6/1974 | Kroger et al. | 156/3 |
| 3,875,442 | A | 4/1975 | Wasa et al. | 313/193 |
| 3,894,332 | A | 7/1975 | Nathanson et al. | 29/578 |
| 3,970,887 | A | 7/1976 | Smith et al. | 313/309 |
| 4,301,429 | A | 11/1981 | Goldman et al. | 333/22 R |
| 4,400,866 | A | 8/1983 | Yeh et al. | 29/571 |
| 4,420,872 | A | 12/1983 | Solo de Zaldivar | 29/571 |
| 4,718,973 | A | 1/1988 | Abraham et al. | 156/628 |
| 4,766,340 | A | 8/1988 | van der Mast et al. | 313/366 |
| 4,874,981 | A | 10/1989 | Spindt | 313/309 |
| 4,943,343 | A | 7/1990 | Bardai et al. | 156/643 |
| 4,964,946 | A | 10/1990 | Gray et al. | 156/643 |
| 4,968,382 | A | 11/1990 | Jacobson et al. | 156/643 |
| 5,063,327 | A | 11/1991 | Brodie et al. | 313/482 |
| 5,090,932 | A | 2/1992 | Dieumegard et al. | 445/24 |
| 5,138,220 | A | 8/1992 | Kirkpatrick | 313/309 |

(Continued)

FOREIGN PATENT DOCUMENTS

| | | |
|---|---|---|
| JP | 57-43412 | 3/1982 |
| JP | 3-238729 | 10/1991 |

OTHER PUBLICATIONS

Hunt, Charles E., Johann T. Trujillo, William J. Orvis, "Structure and Electrical Characteristics of Silicon Field-Emission Microelectronic Devices", IEEE Transactions on Electron Devices, vol. 38, No. 10, Oct. 1991.

(Continued)

*Primary Examiner*—Ashok Patel
(74) *Attorney, Agent, or Firm*—TraskBritt

(57) ABSTRACT

Electron emitters and a method of fabricating emitters are disclosed, having a concentration gradient of impurities, such that the highest concentration of impurities is at the apex of the emitters and decreases toward the base of the emitters. The method comprises the steps of doping, patterning, etching, and oxidizing the substrate, thereby forming the emitters having impurity gradients.

7 Claims, 6 Drawing Sheets

U.S. PATENT DOCUMENTS

| | | | | |
|---|---|---|---|---|
| 5,201,992 | A | 4/1993 | Andreadakis et al. | 156/643 |
| 5,269,877 | A | 12/1993 | Bol | 156/628 |
| 5,315,126 | A | 5/1994 | Field | 257/10 |
| 5,330,920 | A | 7/1994 | Soleimani et al. | 437/24 |
| 5,358,908 | A | 10/1994 | Reinberg et al. | 437/228 |
| 5,372,973 | A | 12/1994 | Doan et al. | 437/228 |
| 5,378,658 | A | 1/1995 | Toyoda et al. | 437/228 |
| 5,431,777 | A | 7/1995 | Austin et al. | 156/622.1 |
| 5,469,014 | A | 11/1995 | Itoh et al. | 313/308 |
| 5,532,177 | A | 7/1996 | Cathey | 437/40 |
| 5,552,613 | A | 9/1996 | Nishibayashi et al. | |
| 5,583,393 | A | 12/1996 | Jones | 313/495 |
| 5,662,815 | A | 9/1997 | Kim | 216/11 |
| 5,703,380 | A | 12/1997 | Potter | |
| 5,757,344 | A * | 5/1998 | Miyata et al. | 345/75.2 |
| 5,786,659 | A | 7/1998 | Takagi et al. | 313/309 |
| 6,031,250 | A | 2/2000 | Brandes et al. | |
| 6,049,089 | A | 4/2000 | Cathey | 257/10 |
| 6,091,188 | A * | 7/2000 | Tomihari et al. | 313/336 |

OTHER PUBLICATIONS

Marcus, R. B., T. S. Ravi, T. Gmitter, H. H. Busta, J. T. Niccum, K. K. Chin and D. Liu. "Atomically Sharp Silicon and Metal Field Emitters," IEEE Transactions on Electron Devices, vol. 38, No. 10, Oct. 1991.

Wolf, Stanley, Silicon Processing for the VLSI Era, vol. 2: Process Integration, Lattice Press, Sunset Beach, California, pp. 20-27, 1990.

Jones, G. W. and C. T. Sune, "Fabrication of Silicon Point, Wedge, and Trench FEAs", Technical Digest of IVMC 91, Nagahama 1991, pp. 34-35.

Millman, J. et al., *Integrated Electronics: Analog and Digital Circuits and System*, pp. 204-205, 1972 (no month).

* cited by examiner

EMITTER

CROSS-REFERENCE TO RELATED APPLICATIONS

This application is a continuation of application Ser. No. 08/609,354, filed Mar. 1, 1996, which is now U.S. Pat. No. 6,825,596, issued Nov. 30, 2004, which is a divisional of application Ser. No. 08/089,166, filed Jul. 7, 1993, which is now U.S. Pat. No. 5,532,177, issued Jul. 2, 1996. There is a continuation application having Ser. No. 08/555,908, which was filed on Nov. 13, 1995, now abandoned. That application is a continuation of application Ser. No. 08/089,166, which was filed on Jul. 7, 1993 and issued as U.S. Pat. No. 5,532,177 on Jul. 2, 1996. Also, there is a divisional of application Ser. No. 08/609,354, which was filed on Sep. 25, 1998 as application Ser. No. 09/161,338, now U.S. Pat. No. 6,049,089 issued Apr. 11, 2000.

FIELD OF THE INVENTION

This invention relates to field emitter technology and, more particularly, to electron emitters and a method for forming them.

BACKGROUND OF THE INVENTION

Cathode ray tube (CRT) displays, such as those commonly used in desk-top computer screens, function as a result of a scanning electron beam from an electron gun impinging on phosphors on a relatively distant screen. The electrons increase the energy level of the phosphors. The phosphors release energy imparted to them from the bombarding electrons, thereby emitting photons, which photons are transmitted through the glass screen of the display to the viewer.

Flat panel displays have become increasingly important in appliances requiring lightweight portable screens. Currently, such screens use electroluminescent, liquid crystal, or plasma technology. A promising technology is the use of a matrix-addressable array of cold cathode emission devices to excite phosphor on a screen.

In U.S. Pat. No. 3,875,442, entitled "Display Panel," Wasa et. al. disclose a display panel comprising a transparent gas-tight envelope, two main planar electrodes which are arranged within the gas-tight envelope parallel with each other, and a cathode luminescent panel. One of the two main electrodes is a cold cathode, and the other is a low potential anode, gate, or grid. The cathode luminescent panel may consist of a transparent glass plate, a transparent electrode formed on the transparent glass plate, and a phosphor layer coated on the transparent electrode. The phosphor layer is made of, for example, zinc oxide which can be excited with low-energy electrons.

Spindt, et. al. discuss field emission cathode structures in U.S. Pat. Nos. 3,665,241; 3,755,704; 3,812,559; and 4,874,981. To produce the desired field emission, a potential source is provided with its positive terminal connected to the gate, or grid, and its negative terminal connected to the emitter electrode (cathode conductor substrate). The potential source may be made variable for the purpose of controlling the electron emission current. Upon application of a potential between the electrodes, an electric field is established between the emitter tips and the grid, thus causing electrons to be emitted from the cathode tips through the holes in the grid electrode.

An array of points in registry with holes in grids is adaptable to the production of gate emission sources subdivided into areas containing one or more tips from which areas of emission can be drawn separately by the application of the appropriate potentials thereto.

There are several methods by which to form the electron emission tips. Examples of such methods are presented in U.S. Pat. No. 3,970,887 entitled, "Micro-structure Field Emission Electron Source."

SUMMARY OF THE INVENTION

The performance of a field emission display is a function of a number of factors, including emitter tip or edge sharpness.

In the process of the present invention, a dopant material which affects the oxidation rate or the etch rate of silicon is diffused into a silicon substrate or film. "Stalks" or "pillars" are then etched, and the dopant differential is used to produce a sharpened tip. Alternatively, "fins" or "hedges" may be etched, and the dopant differential used to produce a sharpened edge.

One of the advantages of the present invention is the manufacturing control and available process window for fabricating emitters, particularly if a high-aspect ratio is desired. Another advantage of the present invention is its scalability to large areas.

BRIEF DESCRIPTION OF THE DRAWINGS

The present invention will be better understood from reading the following description of nonlimitative embodiments, with reference to the attached drawings, wherein.

DETAILED DESCRIPTION OF THE INVENTION

Figure 1:
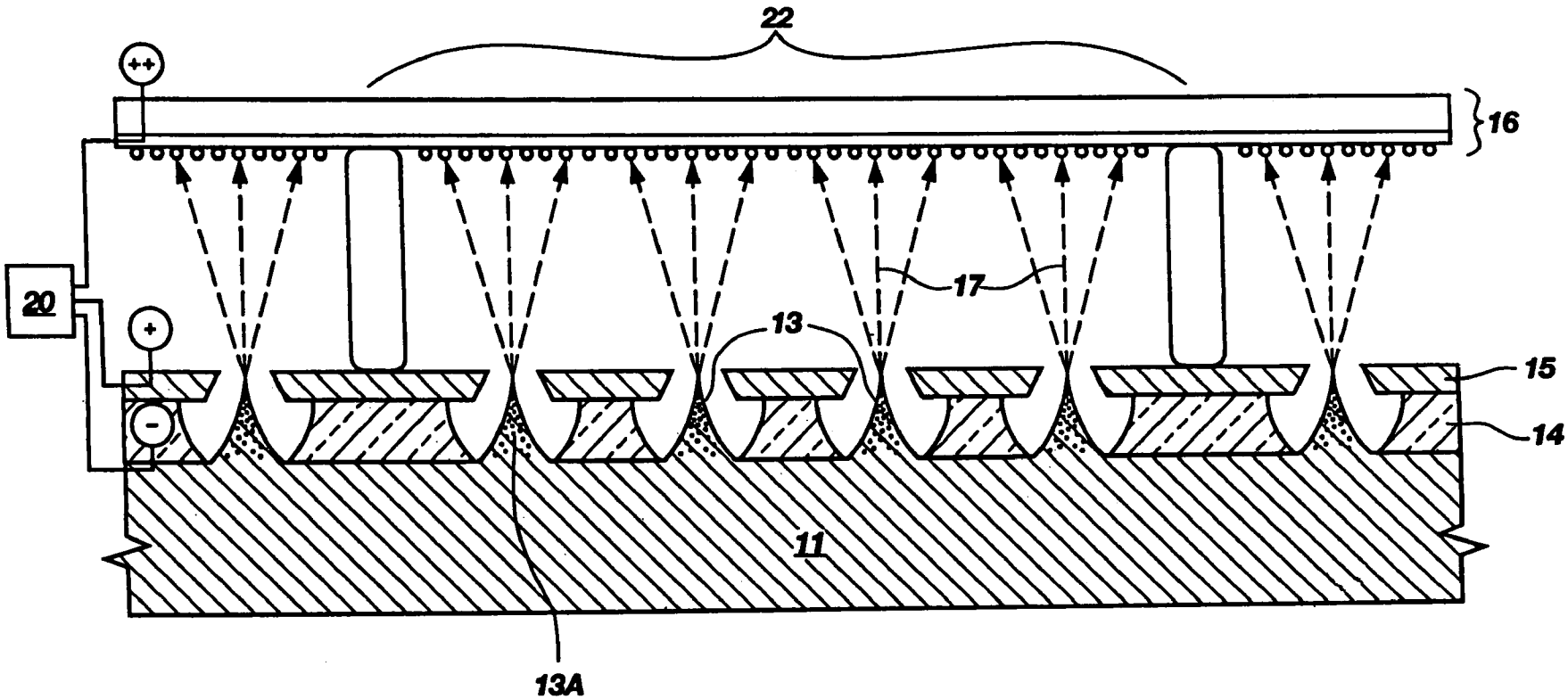
FIG. 1 is a schematic cross-section of a field emission device in which the emitter tips or edges formed from the process of the present invention can be used.
Figure 1A:
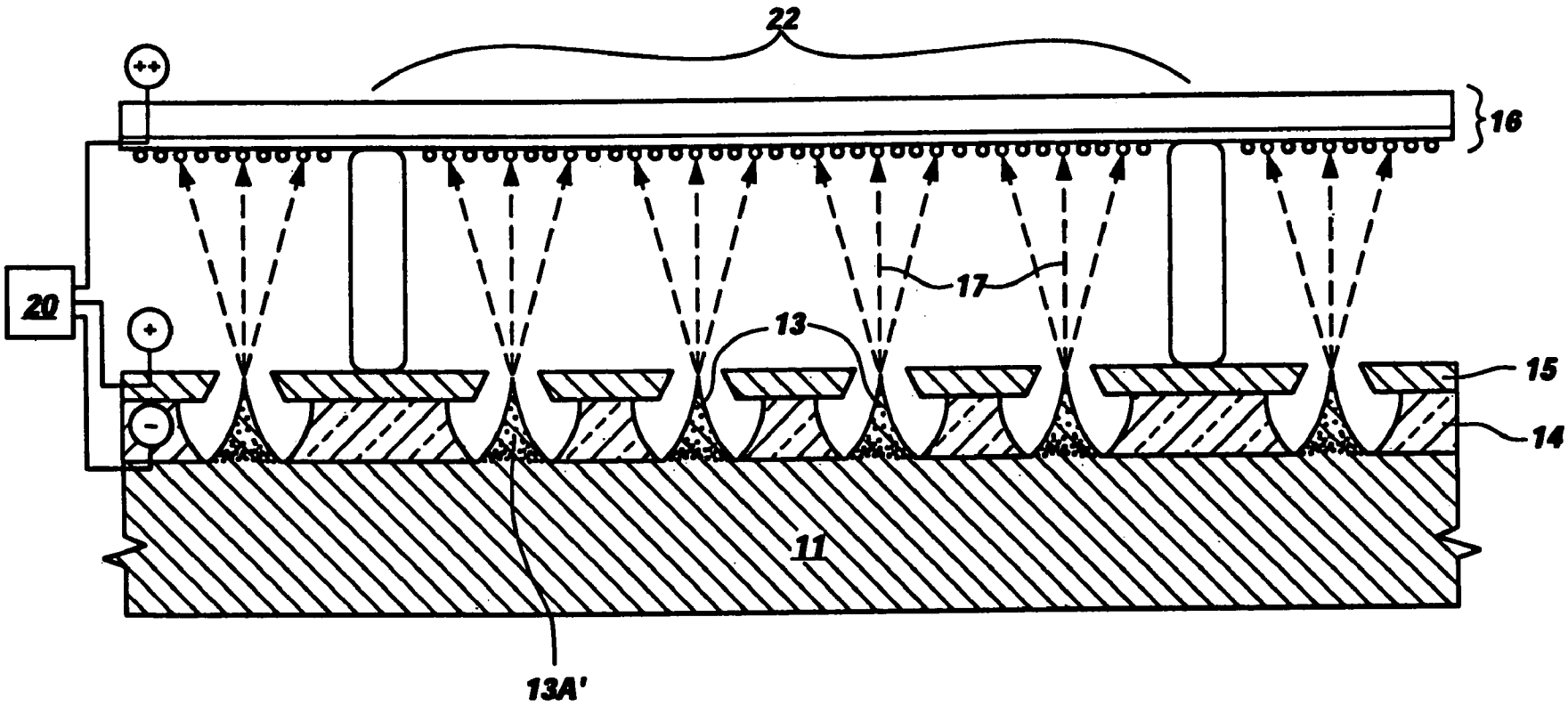
FIG. 1A is a schematic cross-section of a field emission device in which the emitter tips or edges formed from the process of an alternative of the present invention can be used.

Referring to FIG. 1, a field emission display employing a pixel 22 is depicted. In this embodiment, the cold cathode emitter tip 13 of the present invention is depicted as part of the pixel 22. In an alternative embodiment, the emitter 13 is in the shape of an elongated wedge, the apex of such a wedge being referred to as a "knife edge" or "blade."

The schematic cross-sections for the alternative embodiment are substantially similar to those of the preferred embodiment in which the emitters 13 are tips. From a top view (not shown), the elongated portion of the wedge would be more apparent FIG. 1 (FIG. 1) is merely illustrative of the many applications for which the emitter 13 of the present invention can be used. The present invention is described herein with respect to field emitter displays, but one having ordinary skill in the art will realize that it is equally applicable to any other device or structure employing a micro-machined point, edge, or blade, such as, but not limited to, a stylus, probe tip, fastener, or fine needle.

The substrate 11 can be comprised of glass, for example, or any of a variety of other suitable materials, onto which a conductive or semiconductive material layer, such as doped polycrystalline silicon can be deposited. In the preferred embodiment, single crystal silicon serves as a substrate 11, from which the emitters 13 are directly formed. Other substrates may also be used including, but not limited to, macrograin polysilicon and monocrystalline silicon, the selection of which may depend on cost and availability.

If an insulative film or substrate is used with the process of the present invention, in lieu of the conductive or semiconductive film or substrate 11, the micro-cathode 13 should be coated with a conductive or semiconductive material prior to doping.

At a field emission site, a micro-cathode 13 (also referred to herein as an emitter) has been constructed in the substrate 11. The micro-cathode 13 is a protuberance that may have a variety of shapes, such as pyramidal, conical, wedge, or other geometry, which has a fine micro-point, edge, or blade for the emission of electrons. The micro-cathode 13 has an apex and a base. The aspect ratio (i.e., height-to-base width ratio) of the emitters 13 is preferably greater than 1:1. Hence, the preferred emitters 13 have a tall, narrow appearance.

The emitter 13 of the present invention has an impurity concentration gradient, indicated by the shaded area 13A, in which the concentration is higher at the apex and decreases towards the base.

The emitter 13 of an alternative of the present invention has an impurity concentration gradient, indicated by the shaded area 13A', in which the concentration is lower at the apex and increases towards the base.

Surrounding the micro-cathode 13 is an extraction grid or gate structure 15. When a voltage differential, through source 20, is applied between the micro-cathode 13 and the gate structure 15, an electron stream 17 is emitted toward a phosphor-coated screen 16. The phosphor-coated screen 16 functions as the anode. The electron stream 17 tends to be divergent, becoming wider at greater distances from the tip of micro-cathode 13.

The electron emitter 13 is integral with the semiconductor substrate 11 and serves as a cathode conductor. Gate structure 15 serves as and extraction grid for its respective micro-cathode 13. A dielectric insulating layer 14 is deposited on the substrate 11. However, a conductive cathode layer (not shown) may also be disposed between the dielectric insulating layer 14 and the substrate 11, depending upon the material selected for the substrate 11. The dielectric insulating layer 14 also has an opening at the field emission site location.

The process of the present invention, by which the emitter 13 having the impurity concentration gradient is fabricated, is described below.

Figure 2:
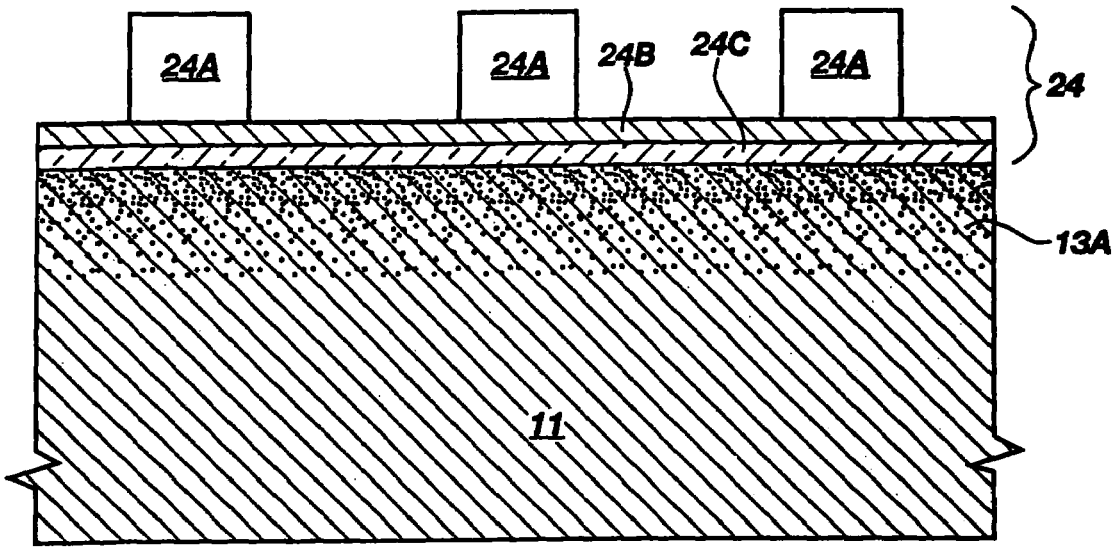
FIG. 2 (FIG. 2) is a schematic cross-section of the doped substrate of the present invention superjacent to which is a mask, which in this embodiment comprises several layers.

FIG. 2 (FIG. 2) shows the substrate or film 1 which is used to fabricate a field emitter 13. The substrate 11 is preferably single crystal silicon. An impurity concentration gradient 13A is introduced into the substrate or film 11 in such a manner so as to create a concentration gradient from the top of the substrate 11 surface, which decreases with depth down into the film or substrate 11. Preferably, the impurity concentration gradient 13A is from the group including, but not limited to, boron, phosphorus, and arsenic.

Figure 2A:
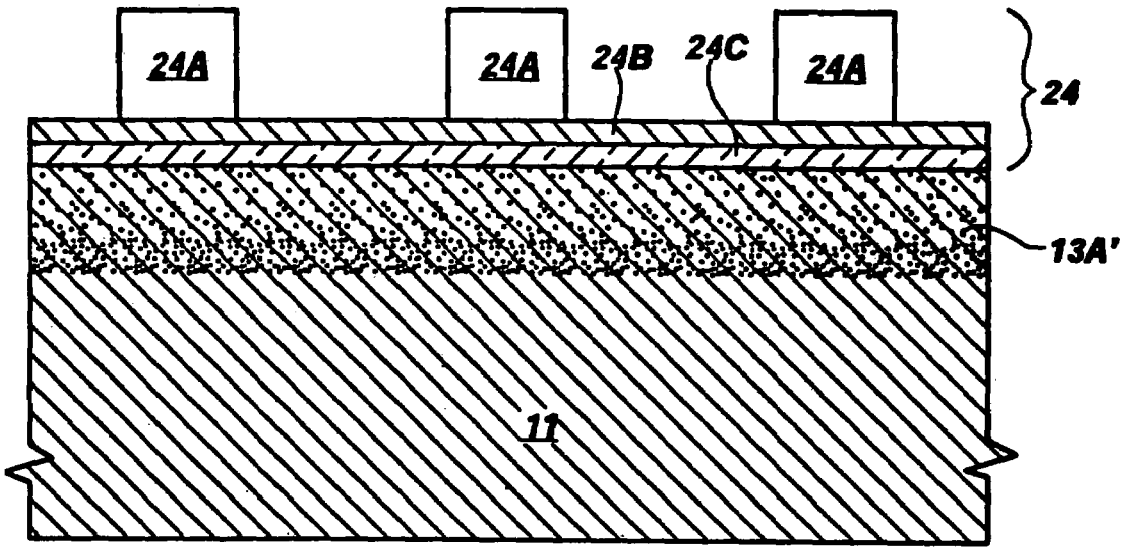
FIG. 2A is a schematic cross-section of another doped substrate of the present invention superjacent to which is a mask, which in this embodiment comprises several layers.

FIG. 2A (FIG. 2A) shows the substrate or film 11 which is used to fabricate a field emitter 13. The substrate 11 is preferably single crystal silicon. An impurity material 13A' is introduced into the film 11 in such a manner so as to create a concentration gradient from the top of the substrate surface 11 which increases with depth down into the film or substrate 11. Preferably, the impurity 13A' is from the group including, but not limited to boron, phosphorus, and arsenic.

The substrate 11 can be doped using a variety of available methods. The impurity concentration gradient 13A can be obtained from a solid source diffusion disc or gas or vapor feed source, such as POC1, or from spin-on dopant with subsequent heat treatment or implantation or CVD film deposition with increasing dopant component in the feed stream, throughout the time of deposition, either intermittently or continuously.

In the case of a CVD or epitaxially grown film, it is possible to introduce an impurity that decreases throughout the deposition and serves as a component for retarding the consumptive process subsequently employed in the process of the present invention. An example is the combination of a silicon film or substrate 11, doped with a boron impurity concentration gradient 13A, and etched with an ethylene diamine pyrocatechol (EDP) etchant, where the EDP is employed after anisotropically etching pillars or fins from substrate 11.

In the preferred embodiment, the substrate 11 is single crystal silicon. After doping, the film or substrate 11 is then patterned, preferably with a resist/silicon nitride/silicon oxide sandwich etch mask 24 and dry etched. Other types of materials can be used to form the sandwich etch mask 24, as long as they provide the necessary selectivity to the substrate 11. The silicon nitride/silicon oxide sandwich has been selected due to its tendency to assist in controlling the lateral consumption of silicon during thermal oxidation, which is well known in semiconductor LOCOS processing.

Figure 3:
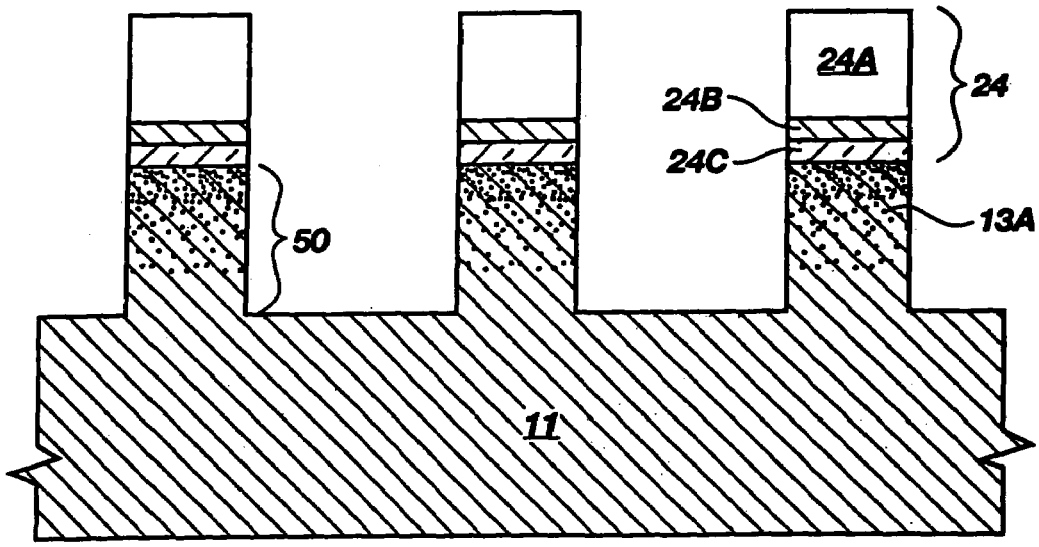
FIG. 3 is a schematic cross-section of the substrate of FIG. 2, after the substrate has been patterned and etched according to the process of the present invention.

The structure of FIG. 2 (FIG. 2) is then etched, preferably using a reactive ion, crystallographic etch, or other etch method well known in the art. Preferably, the etch is substantially anisotropic, i.e., having undercutting that is reduced and controlled, thereby forming "pillars" in the substrate 11, which "pillars" are depicted in FIG. 3 (FIG. 3) and will be the sites of the emitter tips 13 of the present invention.

Figure 3A:
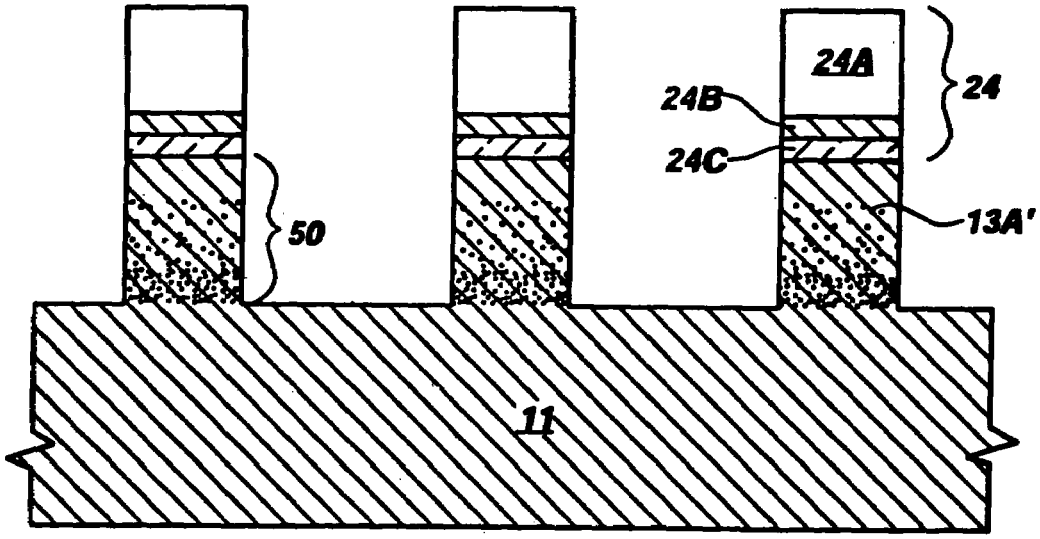
FIG. 3A is a schematic cross-section of the substrate of FIG. 2A, after the substrate has been patterned and etched according to the process of the present invention.

The structure of FIG. 2A (FIG. 2A) is then etched, preferably using a reactive ion, crystallographic etch, or other etch method well known in the art. Preferably, the etch is substantially anisotropic, i.e., having undercutting that is reduced and controlled, thereby forming "pillars" in the substrate 11, which "pillars" are depicted in FIG. 3A (FIG. 3A) and will be the sites of the emitter tips 13 of the present invention.

Figure 4:
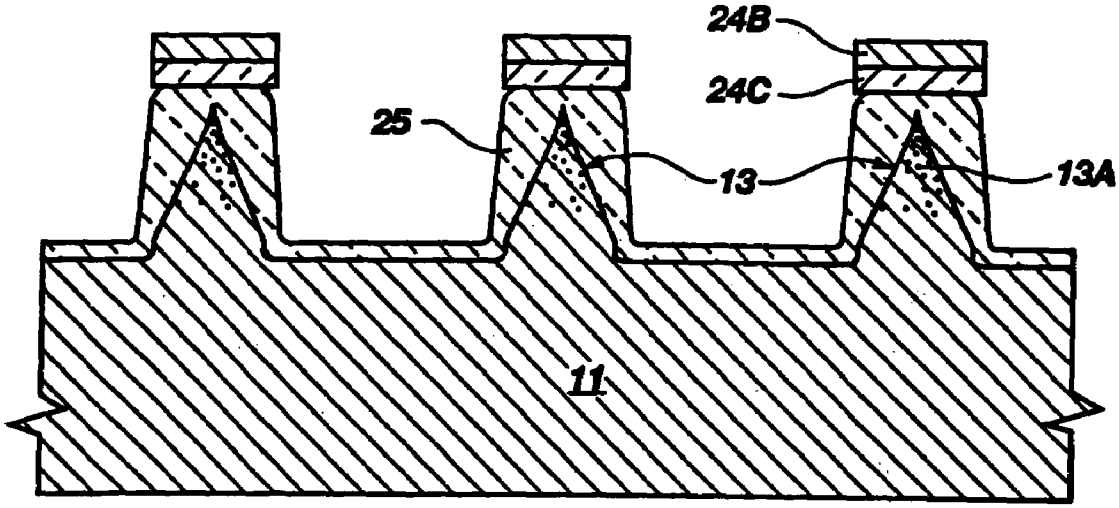
FIG. 4 is a schematic cross-section of the substrate of FIG. 3, after the tips or edges have been formed according to the process of the present invention.

FIG. 4 (FIG. 4) illustrates the substrate 11 having emitter tips 13 formed therein. The resist portion 24A (FIG. 2) of the sandwich etch mask 24 has been removed. An oxidation is then performed, wherein an oxide layer 25 is disposed about the emitter tip 13 and subsequently removed.

Figure 4A:
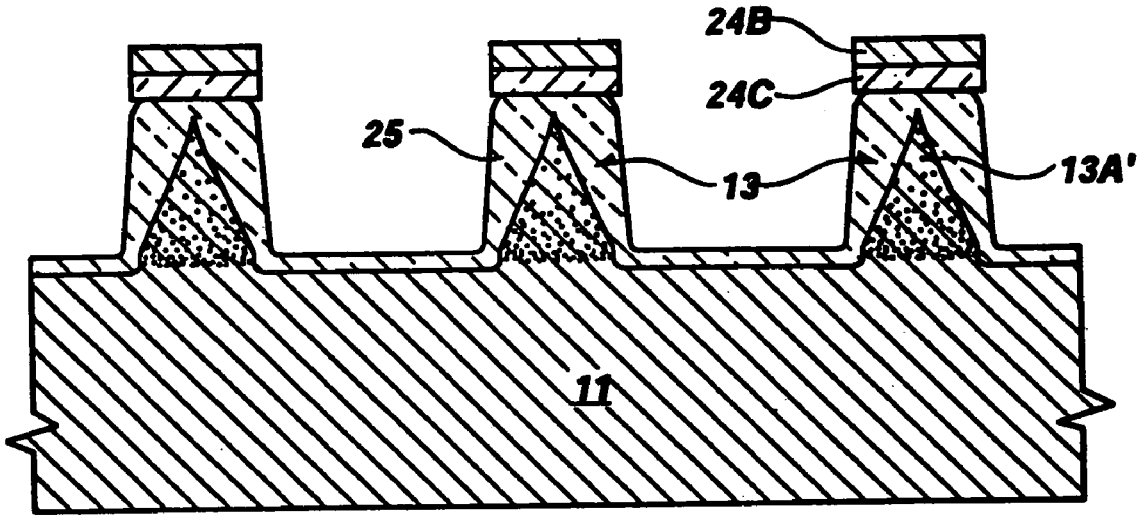
FIG. 4A is a schematic cross-section of the substrate of FIG. 3A, after the tips or edges have been formed according to the process of the present invention.

FIG. 4A (FIG. 4A) illustrates the substrate 11 having emitter tips 13 formed therein. The resist portion 24A (FIG. 2A) of the sandwich etch mask 24 has been removed. An oxidation is then performed, wherein an oxide layer 25 is disposed about the emitter tip 13 and subsequently removed.

Alternatively, an etch is performed, the rate of which is dependent upon (i.e., a function of) the concentration of the contaminants (impurities exposed to a consumptive process, whereby the rate or degree of consumption is a function of the impurity concentration, such as the thermal oxidation of silicon which has been doped with impurity concentration gradient 13A).

The etch, or oxidation, proceeds at a faster rate in areas having higher concentration of impurities. Hence, the emitters 13 are etched faster at the apex, where there is an increased impurity concentration gradient 13A, and slower at the base, where there is a decrease in the impurity concentration gradient 13A.

Figure 5:
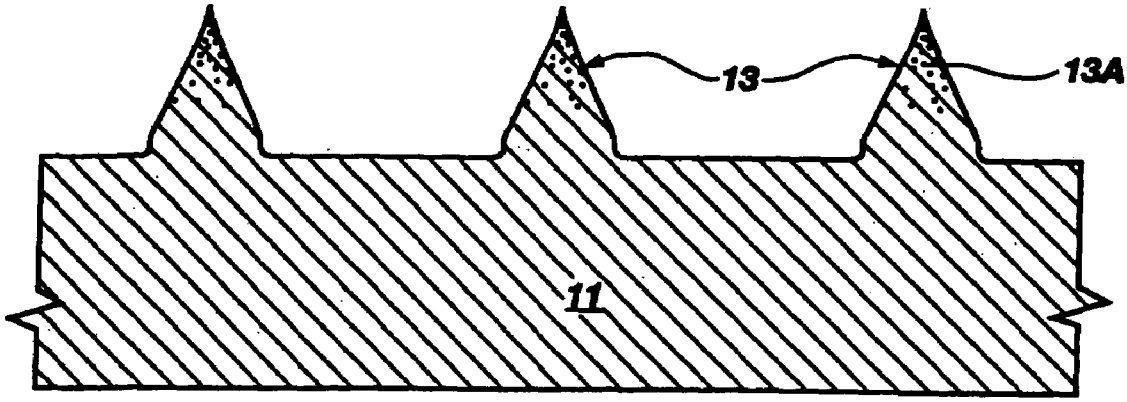
FIG. 5 is a schematic cross-section of the tips or edges of FIG. 4, after the nitride and oxide layers of the mask have been removed.

FIG. 5 (FIG. 5) shows the emitters 13 following the removal of the nitride 24B and oxide 24C layers (shown in FIG. 2); preferably by a selective wet stripping process. An example of such a stripping process involves a 1:100 solution of hydrofluoric acid (HF)/water at 20° C., followed by a water rinse. Next is a boiling phosphoric acid ($H_3PO_4$)/water solution at 140° C., followed by a water rinse and a 1:4 hydrofluoric acid (HF)/water solution at 20° C. The emitters 13 of the present invention are thereby exposed.

Figure 5A:
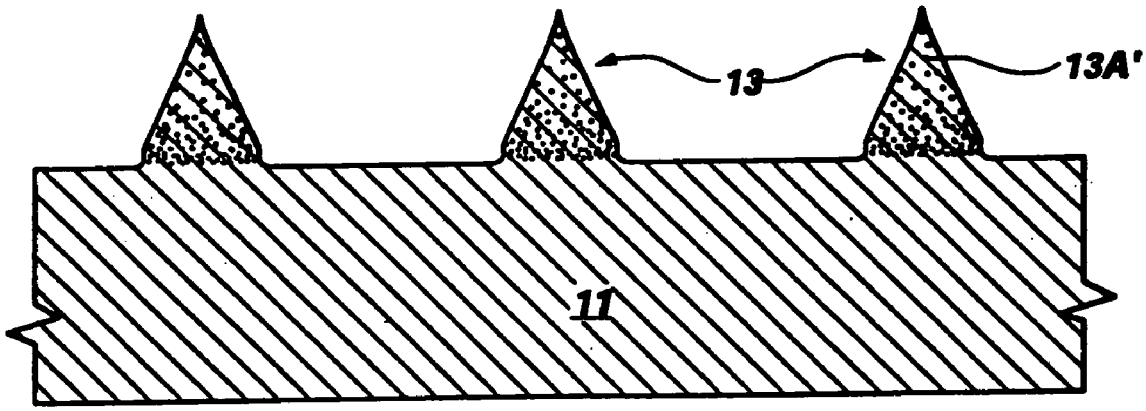
FIG. 5A is a schematic cross-section of the tips or edges of FIG. 4A, after the nitride and oxide layers of the mask have been removed.

FIG. 5A (FIG. 5A) shows the emitters 13 following the removal of the nitride 24B and oxide 24C layers (shown in FIG. 2A); preferably by a selective wet stripping process. An example of such a stripping process involves a 1:100 solution of hydrofluoric acid (HF)/water at 20° C., followed by a water rinse. Next is a boiling phosphoric acid ($H_3PO_4$)/water solution at 140° C., followed by a water rinse and a 1:4 hydrofluoric acid (HF)/water solution at 20° C. The emitters 13 of the present invention are thereby exposed.

The etch is preferably nondirectional in nature, removing material of a selected purity level in both horizontal and vertical directions, thereby creating an undercut. The amount of undercut is related to the impurity concentration gradient 13A.

All of the U.S. patents cited herein are hereby incorporated by reference herein as if set forth in their entirety.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, one having ordinary skill in the art will realize that the emitters can be used in a number of different devices, including but not limited to field emission devices, cold cathode electron emission devices, and micro-tip cold cathode vacuum triodes.

What is claimed is:

1. A pixel, comprising:

a single-layered substrate further comprising:

at least one protuberance formed into the substrate, the at least one protuberance having an apex; and an impurity offset from the apex of the at least one protuberance, said impurity within said protuberance having a concentration increasing concurrently with a distance from the apex.

2. A field emission display, comprising:

a portion of a single-layered substrate, the portion being an uncontaminated single-layered substrate that is at least semiconductive formed from a single-layered substrate; and a micro-cathode located in a portion of said substrate formed from the portion of the single-layered substrate further comprising:

an increasingly contaminated body, the concentration of the impurity increasing from a contaminated apex of the micro-cathode.

3. The field emission display of claim 2, wherein said micro-cathode is integral with said substrate.

4. A display panel, comprising:

a substrate comprising semiconductive material formed from a single-layered substrate; and an emitter electrode located in a portion of said substrate, further comprising an apex having an etch-resistible quality that decreases with the distance from said apex.

5. The display panel in claim 4, wherein said emitter electrode further comprises a base and further has an oxidizable quality that increases with elevation from said base.

6. The display panel in claim 5, wherein a portion of said substrate that is under said emitter electrode has an etch-resistible quality generally similar to an etch-resistible quality of said base.

7. The display panel in claim 6, wherein said portion has an oxidizable quality generally similar to an oxidizable quality of said base.

* * * * *